US005522780A

United States Patent [19]

Roddy

[11] Patent Number: 5,522,780

[45] Date of Patent: Jun. 4, 1996

[54] DISCUS FOR THROWING

[76] Inventor: Craig W. Roddy, 3000 S. 9th St., Apt. 63, Chickasha, Okla. 73018

[21] Appl. No.: 393,086

[22] Filed: Feb. 22, 1995

[51] Int. Cl.[6] ..... A63B 65/10

[52] U.S. Cl. ..... 482/21; 273/424

[58] Field of Search ..... 273/424, 425; 446/46, 47, 48; 482/20, 21

[56] References Cited

U.S. PATENT DOCUMENTS

| | | | |
|---|---|---|---|
| 1,006,628 | 10/1911 | Burr | 482/21 |
| 1,433,437 | 10/1922 | Wakeham | 273/424 X |
| 1,492,976 | 5/1924 | Gill | 482/21 |
| 5,123,869 | 6/1992 | Schipmann | 446/46 |

FOREIGN PATENT DOCUMENTS

| | | | |
|---|---|---|---|
| 1535551 | 1/1990 | U.S.S.R. | 273/424 |

*Primary Examiner*—William H. Grieb

[57] ABSTRACT

A discus for throwing is provided in conformance with rules and specifications established by track and field governing bodies, such as The Athletics Congress of the USA and the International Amateur Athletic Federation. The preferred discus has top and bottom sides and a metal rim, the edge of which is circular. Each side has a metal plate set flush in the center thereof, wherein the plates are flat and circular. The sides taper in a straight line from the beginning of the curve of the rim to a circle having a radius from the center of the discus; thus, the discus is thicker in the center than at the perimeter. An imaginary equatorial plane divides the discus into top and bottom halves and is perpendicular to a central imaginary line referred to as the axis of rotation, wherein the discus rotates about the axis of rotation when thrown. The discus has an asymmetrical weight distribution between the top and bottom halves thereof. Wherefore, the preferred discus has a center of gravity biased towards the top side, which is adjacent a person's throwing hand when throwing the discus.

20 Claims, 4 Drawing Sheets

DISCUS FOR THROWING

BACKGROUND

The present invention relates generally to a discus, and more particularly to a discus for a person to throw in track and field athletics as a test of skill and strength.

In ancient Greece, discus throwing was considered the paramount event of the Olympic games. Today, the tradition of discus throwing has been preserved through a myriad of track and field competitions.

A conventional discus includes a circular rim with somewhat convex top and bottom sides coupled thereto; thus, the discus is thicker in the center than at the perimeter. The outer edge of the rim generally defines the discus into top and bottom halves, wherein the top half contains the top side and the bottom half contains the bottom side. The weight of each known discus is substantially equally divided between the top and bottom halves thereof. Further, many discuses have their weight concentrated in the rim to provide a high rotary inertia, whereby the discus spins for a longer time while in the air and travels farther before landing.

However, until now, no discus has been provided with means for providing an asymmetrical weight distribution between the top and bottom halves, wherein the means for providing an asymmetrical weight distribution is biased toward the perimeter of the discus.

SUMMARY

The embodiment of the invention is directed to a discus for throwing which has an asymmetrical weight distribution between top and bottom halves thereof, and is particularly well suited for use in track and field competition where a maximum throwing distance is desired.

The preferred version of the invention comprises a discus in conformance with rules and specifications established by track and field governing bodies, such as The Athletics Congress of the USA and the International Amateur Athletic Federation. The discus has top and bottom sides made of plastic, wood or other suitable material known in the art, and a metal rim, the edge of which is circular. Each side has a metal plate set flush in the center thereof, wherein the plates are flat and circular. In the alternative, the discus is made without the metal plates such that the equivalent area of the discus is flat and the discus corresponds to the specifications established by the governing bodies.

The sides of the discus are made without indentations, projections, or sharp edges. Further, the sides taper in a straight line from the beginning of the curve of the rim to a circle having a radius from the center of the discus; thus, the discus is thicker in the center than at the perimeter. An imaginary equatorial plane divides the discus into top and bottom halves and is perpendicular to a central imaginary line referred to as the axis of rotation, wherein the discus rotates about the axis of rotation when thrown.

The discus has means for providing an asymmetrical weight distribution between the top and bottom halves thereof. The means for providing an asymmetrical weight distribution is located outside a cylindrical area of the discus, wherein the cylindrical area is spaced between and defined by the flat, circular areas of the top and bottom sides. More particularly, a preferred embodiment of the invention includes the means for providing an asymmetrical weight distribution being located in the rim of the discus. Thus, the preferred discus has a center of gravity biased towards the top side, which is adjacent to a person's throwing hand when throwing the discus.

As such, it is a first object of the present invention to provide an efficient, economical, and simple discus for throwing.

It is a further object of the present invention to provide a discus for throwing which conforms to rules and specifications established by track and field governing bodies, such as The Athletics Congress of the USA and the International Amateur Athletic Federation.

It is a further object of the present invention to provide a discus for throwing which has an asymmetrical weight distribution between top and bottom halves thereof.

It is a further object of the present invention to provide a discus for throwing which has a center of gravity biased towards a side thereof.

It is a further object of the present invention to provide a discus for throwing which has a center of gravity biased towards a person's throwing hand when throwing the discus.

It is a further object of the present invention to provide a discus for throwing which includes means for providing an asymmetrical weight distribution between top and bottom halves of the discus, wherein the means for providing an asymmetrical weight distribution is located outside a cylindrical area that is spaced between and defined by flat, circular areas of top and bottom sides.

It is a further object of the present invention to provide a discus for throwing which has a rim with means for asymmetrically distributing weight between top and bottom halves of the discus.

It is a final object of the present invention to provide a discus for throwing which may be thrown farther than a conventional discus.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1:
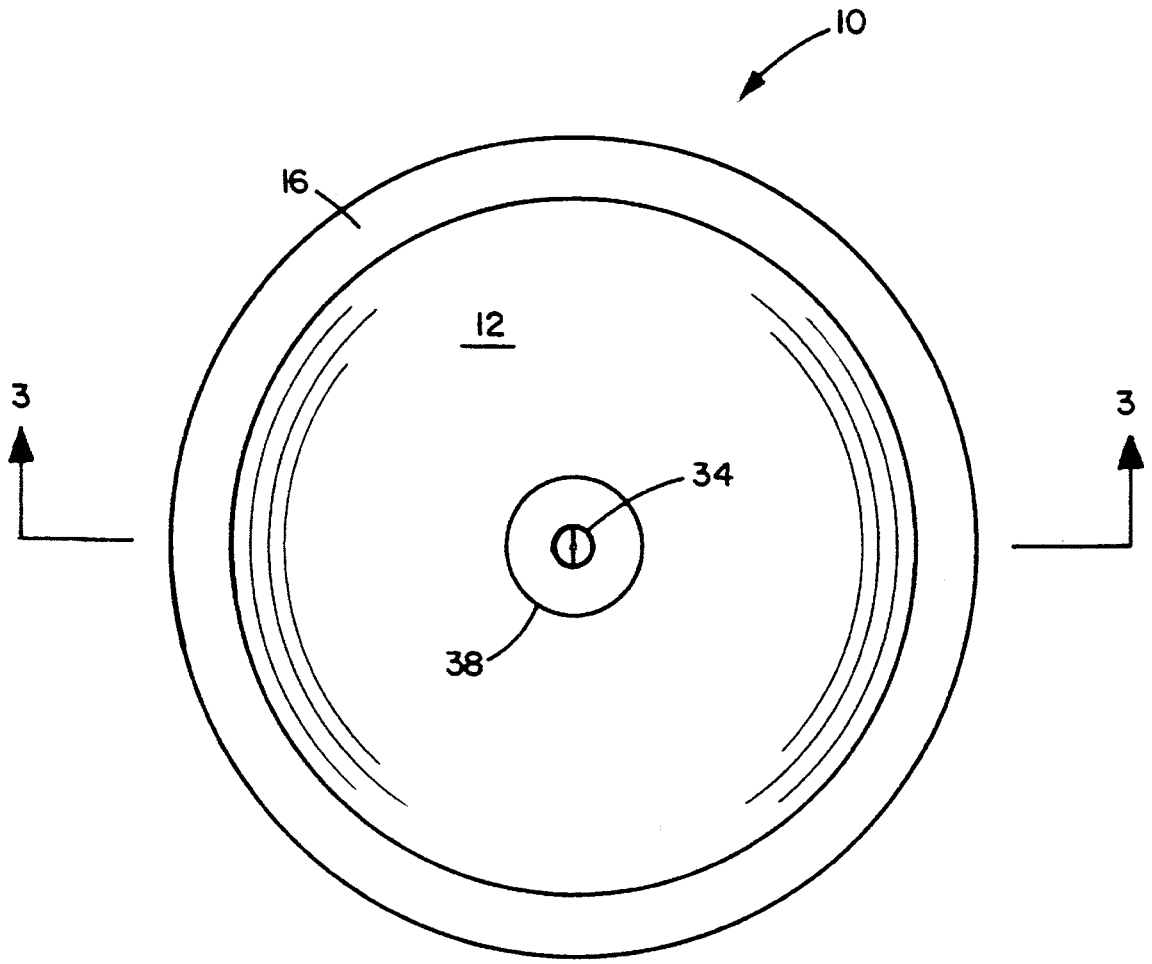
FIG. 1 is a top plan view of a discus constructed in accordance with the present embodiment of the invention.
Figure 2:
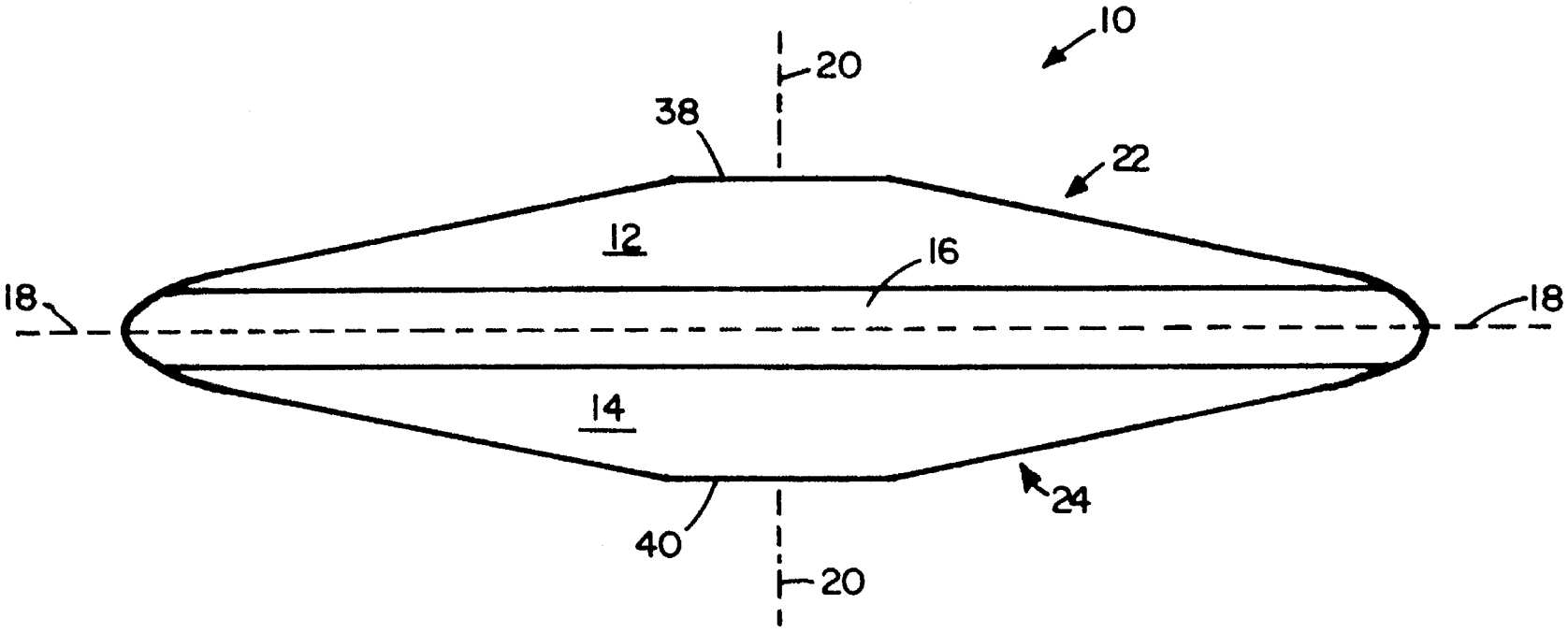
FIG. 2 is a side elevation view of the discus in FIG. 1.

As illustrated in FIGS. 1 and 2, the preferred embodiment of the invention relates to a discus 10, which conforms to rules and specifications established by track and field governing bodies, such as The Athletics Congress of the USA and the International Amateur Athletic Federation. The discus 10 has top and bottom sides 12, 14 made of plastic, wood or other suitable material, and a metal rim 16, the edge of which is circular.

The outer edge of the rim 16 defines an imaginary equatorial plane 18 which is perpendicular to a central imaginary line referred to as an axis of rotation 20, wherein the plane 18 divides the discus 10 into a top half 22 and a bottom half 24. Furthermore, the discus 10 rotates about the axis of rotation 20 when thrown.

The rim 16 is ring-shaped, and the weight of the discus 10 is generally concentrated in the rim 16. Preferably, the rim 16 is made of steel or other suitable metal known in the art.

Figure 3:
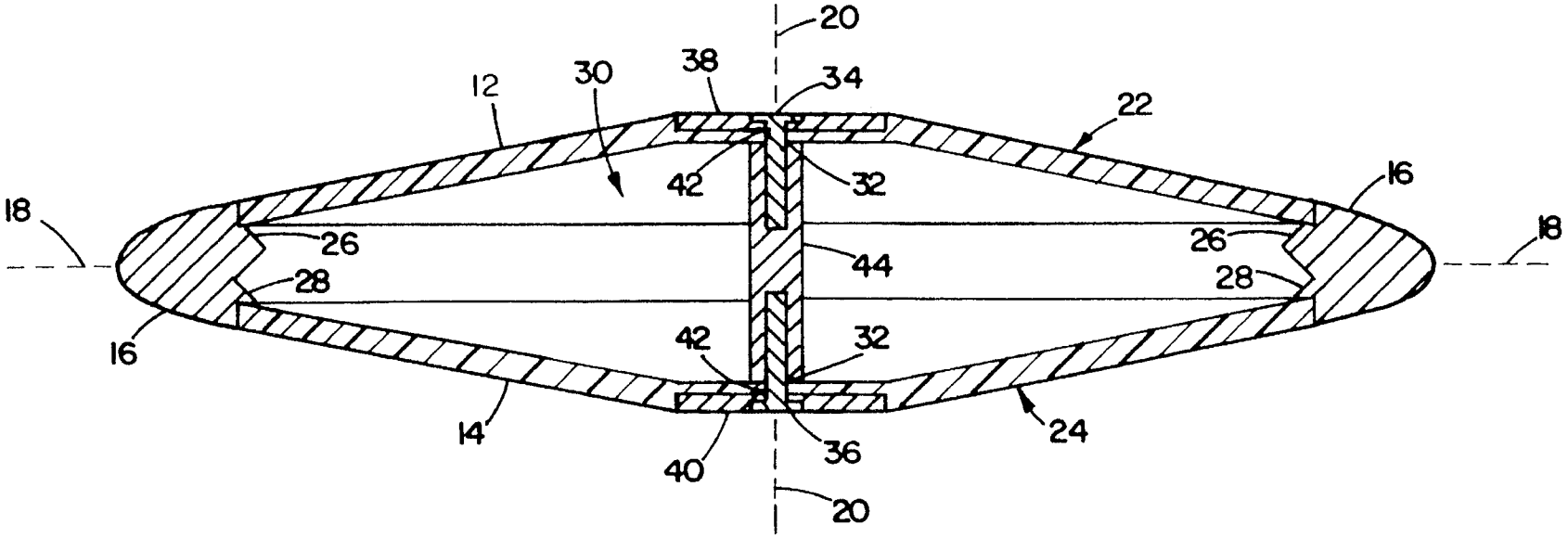
FIG. 3 is a cross section view taken along line 3—3 of FIG. 1, which includes a specially designed rim to asymmetrically distribute the weight of the discus.

As illustrated in FIG. 3, the rim 16 has an inner edge which is specially designed to provide a preferred means for asymmetrically distributing the weight of the discus 10 between the top and bottom halves 22, 24. The inner edge of the rim 16 generally tapers between the top and bottom sides 12, 14, wherein the rim 16 has an asymmetrical weight distribution. Moreover, the inner portion of the rim 16 may comprise any configuration which provides the discus 10 with a means for asymmetrically distributing the weight of the discus 10 between the top and bottom halves 22, 24.

The rim 16 may be specially designed or constructed to produce various asymmetric weight distributions between the top and bottom halves 22, 24. Preferably, the top half 22 of the discus 10 contains more weight than the bottom half 24 thereof.

Figure 4:
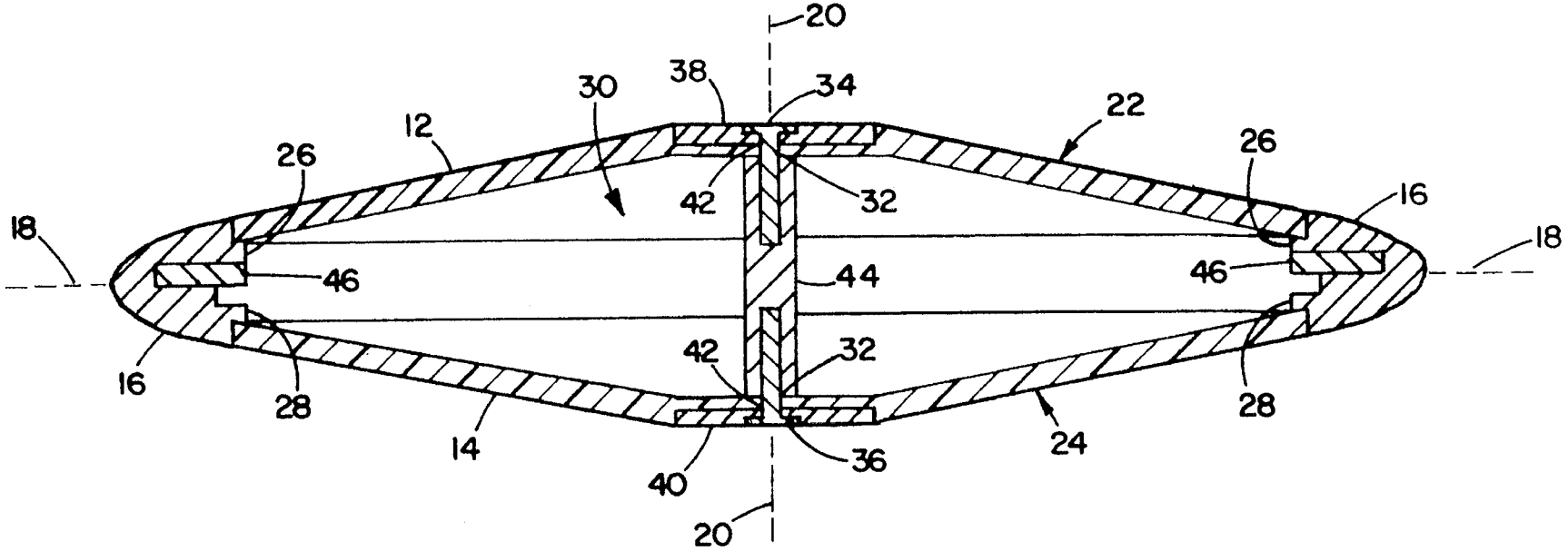
FIG. 4 is a cross section view of an alternative embodiment of the invention which includes a rim having an inset to asymmetrically distribute the weight of the discus.

Referring to FIGS. 2–4, the top and bottom sides 12, 14 are positioned adjacent to the rim 16. The top half 22 contains the top side 12, and the bottom half 24 contains the bottom side 14. Moreover, when a person is throwing the discus 10, the top side 12 is positioned against the palm of the person's throwing hand.

The sides 12, 14 of the discus 10 are made without indentations, projections, or sharp edges. Further, the sides 12, 14 taper in a straight line from the beginning of the curve of the rim 16 to a circle having a radius from the center of the discus 10; wherefore, the discus 10 is thicker in the center than at the perimeter.

As shown in FIGS. 3–4, the inner edge of the rim 16 forms a top lip 26 and a bottom lip 28. The top side 12 is positioned against the top lip 26 while the bottom side 14 is positioned against the bottom lip 28. Therefore, the top and bottom sides 12, 14 enclose the ring-shaped rim 16 to form an interior void 30. In addition, each side 12, 14 contains a hole 32 centrally defined therethrough for accepting respective top and bottom fasteners 34, 36, such as screws known in the art.

Referring to FIGS. 2–4, a top metal plate 38 is set flush into the center of the top side 12, and a bottom metal plate 40 is set flush into the center of the bottom side 14. Each plate 38, 40 is flat and circular with a central opening 42 defined therethrough for receiving the respective top and bottom fasteners 34, 36. In an alternative (not shown), the discus 10 is made without the metal plates 38, 40, wherein the equivalent area of the discus 10 is flat and the discus 10 corresponds to the specifications established by the governing bodies. The area of the discus established through the middle thereof, which is spaced between and defined by the circular plates 38, 40 or equivalent areas, is a cylindrical area of the discus 10.

The opening 42 of the top plate 38 is aligned with the hole 32 of the top side 12, and the opening 42 of the bottom plate 40 is aligned with the hole 32 of the bottom side 14. Therefore, the top fastener 34 is received through the top plate 38 and top side 12 while the bottom fastener 36 is received through the bottom plate 40 and bottom side 14.

As shown in FIGS. 3 and 4, a coupling means 44 known in the art, such as a nut for accepting opposed screws, is located in the void 30 to couple with the top and bottom fasteners 34, 36. The fasteners 34, 36 are coupled with the coupling means 44, wherein the rim 16, sides 12, 14, and plates 38, 40 are secured together to form the discus In an alternative embodiment shown in FIG. 4, the rim 16 includes an inset 46 to provide a means for asymmetrically distributing the weight of the discus 10 between the top and bottom halves 22, 24. The inset 46 is preferably made of a metal having a greater density than that used to construct the rim 16; however, numerous combinations of suitable materials may be used for constructing the rim 16 and inset 46. In addition, the rim 16 may be specially constructed to accommodate the inset 46 and maintain a desired weight, see FIG. 4.

Numerous shapes and sizes of weighted objects (not shown) may be used to provide means for asymmetrically distributing the weight of the discus 10 between the top and bottom halves 22, 24. Further, the weighted object may be positioned within the discus 10 using any means known in the art, including attachment with the sides 12, 14, rim 16, or coupling means 44.

Another alternative embodiment of the invention (not shown), includes the top and bottom sides 12, 14 being varied in size, density, or construction to provide a means for asymmetrically distributing the weight of the discus 10 between the top and bottom halves 22, 24. Preferably, the top side 12 is heavier than the bottom side 14, wherein more than half of the weight of the discus 10 is located in the top half 22.

Yet, another alternative embodiment of the invention (not shown), includes the metal plates 38, 40 being varied in size, density, or construction, to provide a means for asymmetrically distributing the weight of the discus 10 between the top and bottom halves 22, 24. Preferably, the top half 22 of the discus 10 contains more weight than the bottom half 24 thereof.

The asymmetrical weight distribution of the discus 10 is defined as having more than half the total weight of the discus 10 positioned in either the top half 22 or the bottom half 24 thereof. Hence, the discus 10 has a center of gravity located in either the top half 22 or the bottom half 24.

Preferably, the discus 10 has at least fifty-one (51%) percent of its total weight located in the top half 22. Wherefore, the center of gravity of the discus 10 is appreciably biased towards the top side 12, which is adjacent the person's throwing hand when throwing the discus 10.

While the discus 10 has an asymmetrical weight distribution between the top and bottom halves 22, 24, the weight of the discus 10 is also distributed radially symmetrical about the axis of rotation 20 to allow balanced rotation of the discus 10 when thrown. Further, various asymmetrical weight distributions between the top and bottom halves 22, 24 will be desired for persons having different levels of throwing ability.

The present invention is useful for throwing in track and field athletics and has many advantages as compared to discuses known in the art. In addition, numerous means may be utilized to asymmetrically distribute the weight of the discus 10 between the top and bottom halves 22, 24, wherein the weight of the discus 10 is preferably biased towards a person's throwing hand when throwing the discus 10.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A discus, comprising:

a rim;

means for asymmetrically distributing weight of the discus between top and bottom halves thereof; and wherein said means for asymmetrically distributing weight of the discus is located in said rim.

2. The discus as recited in claim 1, wherein:

the discus includes top and bottom sides adjacent said rim; and the discus has a center of gravity biased towards one of said sides.

3. The discus as recited in claim 1, wherein:

one of the halves of the discus contains more weight than the other half thereof.

4. The discus as recited in claim 1, wherein:

said means for asymmetrically distributing weight of the discus includes said rim having a generally tapered inner edge.

5. The discus as recited in claim 1, wherein:

said means for asymmetrically distributing weight of the discus includes said rim having an asymmetrical configuration.

6. The discus as recited in claim 1, wherein:

said means for asymmetrically distributing weight of the discus includes said rim having an inset.

7. The discus as recited in claim 1, wherein:

said means for asymmetrically distributing weight is integral with said rim.

8. The discus as recited in claim 1, wherein:

said means for asymmetrically distributing weight of the discus includes said rim being asymmetrically weighted.

9. A discus for throwing, comprising:

a rim;

top and bottom sides adjacent said rim; and means for asymmetrically distributing weight of the discus between top and bottom halves thereof wherein said means for asymmetrically distributing weight is located in said rim.

10. The discus as recited in claim 9, wherein:

the discus has a center of gravity biased towards one of said sides.

11. The discus as recited in claim 9, wherein:

said means for asymmetrically distributing weight of the discus includes said rim having a generally tapered inner edge.

12. The discus as recited in claim 9, wherein:

said means for asymmetrically distributing weight of the discus includes said rim having an asymmetrical configuration.

13. The discus as recited in claim 9, wherein:

said means for asymmetrically distributing weight of the discus includes said rim having an inset.

14. The discus as recited in claim 9, wherein:

said means for asymmetrically distributing weight is integral with said rim.

15. The discus as recited in claim 9, wherein:

said means for asymmetrically distributing weight of the discus includes said rim being asymmetrically weighted.

16. A discus, comprising:

a rim;

a top side having a generally flat, circular area in the center thereof, wherein said top side tapers in a straight line from said rim to the circular area of said top side;

a bottom side having a generally flat, circular area in the center thereof, wherein said bottom side tapers in a straight line from said rim to the circular area of said bottom side;

means for providing an asymmetrical weight distribution between top and bottom halves of the discus;

wherein said means for providing an asymmetrical weight distribution is located outside a cylindrical area of the discus; and wherein the cylindrical area is spaced between and defined by the circular areas of said top and bottom sides.

17. The discus as recited in claim 16, wherein:

said means for providing an asymmetrical weight distribution is biased toward a perimeter of the discus.

18. The discus as recited in claim 16, wherein:

said rim includes said means for providing an asymmetrical weight distribution.

19. The discus as recited in claim 16, wherein:

said means for providing an asymmetrical weight distribution includes said rim being asymmetrically weighted.

20. The discus as recited in claim 16, wherein:

said means for providing an asymmetrical weight distribution includes said rim having an asymmetric configuration.

* * * * *